US007461610B1

(12) United States Patent
Czepizak et al.

(10) Patent No.: US 7,461,610 B1
(45) Date of Patent: Dec. 9, 2008

(54) TOWLINE GUIDE CLIP

(75) Inventors: Kurt M. Czepizak, Wakefield, RI (US); Norman Toplosky, South Kingstown, RI (US); Donald E. Cressman, Saunderstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/830,927

(22) Filed: Jul. 31, 2007

(51) Int. Cl.
*B63B 21/04* (2006.01)

(52) U.S. Cl. ..... 114/218

(58) Field of Classification Search ..... 114/218; 24/132 R, 134 N
See application file for complete search history.

(56) References Cited

U.S. PATENT DOCUMENTS 398,631 A * 2/1889 Lassoe ..... 114/246
2,531,003 A * 11/1950 Slaker ..... 24/510
2,596,635 A * 5/1952 Wolfe ..... 24/503
2,721,088 A 10/1955 Ritter, Jr.
3,083,992 A 4/1963 Post
3,096,551 A * 7/1963 Shoberg ..... 24/132 R
3,604,388 A 9/1971 Brown
4,428,142 A 1/1984 Shedd et al.
4,698,933 A 10/1987 Shaw
4,825,583 A 5/1989 Kammerand
4,989,531 A 2/1991 Humphrey
5,337,510 A 8/1994 McCue
5,806,452 A * 9/1998 Benoit ..... 114/218
6,108,877 A * 8/2000 Anscher et al. ..... 24/481
6,662,741 B1 12/2003 Van Der Laan
6,925,951 B1 * 8/2005 DeLong ..... 114/218

* cited by examiner

*Primary Examiner*—Stephen Avila
(74) *Attorney, Agent, or Firm*—James M. Kasischke; Jean-Paul A. Nasser; Michael P. Stanley

(57) ABSTRACT

The invention as disclosed is a towline guide clip, an apparatus that can hold a towline in place as it is dragged behind a large host marine vessel attempting to recover a small marine vessel. The towline guide clip is designed to gradually release the towline when a small marine vessel grabs hold of the line. The additional dragging force of the small marine vessel pulls the towline out of the towline guide clip so that the towline can then be reeled in by a winch.

4 Claims, 6 Drawing Sheets

TOWLINE GUIDE CLIP

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION (1) Field of the Invention

The present invention is directed to floating towlines on docking ships. In particular, the present invention is directed to a floating towline assembly that employs towline guide clips to make the towline more accessible.

(2) Description of the Prior Art

There exists a need to facilitate the process of recovering small sea vessels onto larger host ships by way of a stern ramp. During normal recovery, the process takes a skilled boatman to navigate a small vessel up a stern ramp. The process is even more difficult at high sea states. Small vessel recovery is often facilitated by use of a floating towline that is dragged behind the ramp of the larger host ship. The towline is anchored at one end to prevent that end from moving. The other end of the towline is controlled via a winch, onboard the large host ship. As the towline is being dragged behind the ramp in a large loop, the smaller vessel will grab the towline with a hook, in a similar motion to that of a shirt hangar being hung up on a closet pole. After the hook has latched onto the towline, the winch will begin to reel in the towline, thereby pulling the smaller vessel into the larger host ship.

When the towline is being dragged from the larger host ship the impending shape of the towline must be controlled. The towline is difficult to capture with a latch hook when it takes a very acute "v" shape as it is being dragged through water. The optimum shape for a floating towline is a wide loop perpendicular to the direction that the large host ship is moving. To create the optimum shape, the towline would have to be separated before being dragged behind the host ship in the water.

One way to create the optimum shape for a towline would be to space the winch and towline anchoring mounting plate far enough apart. Forcing the winch and mounting plate for the anchor end of the towline apart, however, limits the available spacing, as well as the distance the rope could be trailed behind the host ship. Furthermore, as a smaller vessel is towed towards the host ship, the angle that the towline would pull from would grow larger in respect to the centerline of the winch, creating a less efficient system for the winch. The winch and mount plate for the anchor end of the towline therefore should be placed in the centerline of the large host ship so that the small vessel is towed directly up the ramp to maximize the efficiency of the winch. A compromise between easily grabbing the rope and maximizing winch efficiency is to temporarily create the optimum shape of a wide loop through the use of a guide and release mechanism for the towline that holds the optimum shape of the towline until a small vessel hooks the line after which the mechanism releases the towline.

Mechanisms have been created to release a towline under certain circumstances. Common applications for towline release mechanisms are in use in the fishing industry. For example, U.S. Pat. No. 5,197,223 to Spurgeon discloses a mechanism called the downrigger line tender control, wherein a line is held in a certain position, and under certain loading conditions, the line is released. In the downrigger line tender control, however, the line being held in position is not allowed to move until the outside loading conditions are presented. This mechanism is not suitable for the launch and recovery of small vessels onto larger host ships by way of a stern ramp because the towline must be capable of being reeled out while in the guided condition, to adjust the length of towline being dragged behind the larger host ship. The mechanism also attaches to another line, not a stable platform. What is needed is a guide and release mechanism for a towline that allows the towline to maintain its optimum shape to be easily hooked and maximizes winch efficiency.

SUMMARY OF THE INVENTION

It is a general purpose and object of the present invention to provide a towline guide clip that will hold a towline while a host ship is underway and under tension from drag, create the optimum towline shape in the water.

It is a further object that when the tension in the towline is increased by a greater pulling force from a small vessel latching onto the towline, that the towline guide clip will release the towline to make a direct line of tension between a winch on the host ship and the smaller vessel.

The above object is accomplished with the present invention through the use of towline guide clips that are mounted at either side of the stern ramp opposite each other and that hold the towline in the optimum position while it is being dragged behind the host ship. The towline guide clips are spring loaded with a tension that is capable of holding the towline under minimum drag force conditions as it is dragged behind the host ship, but that will release the line as the drag force increases when a smaller ship latches onto the towline.

BRIEF DESCRIPTION OF THE DRAWINGS

A more complete understanding of the invention and many of the attendant advantages thereto will be more readily appreciated by referring to the following detailed description when considered in conjunction with the accompanying drawings, wherein like reference numerals refer to like parts and wherein.

DETAILED DESCRIPTION OF THE INVENTION

Figure 2:
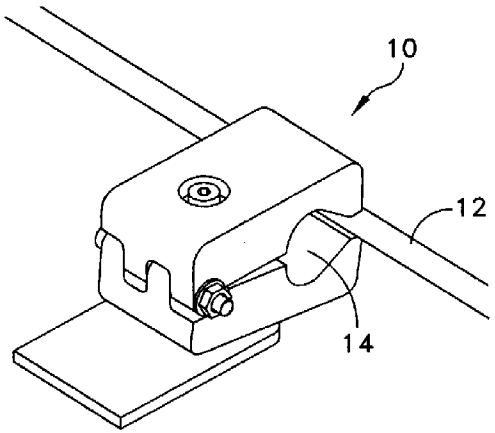
FIG. 2 is an illustration of the towline guide clip in the process of releasing a towline.
Figure 1:
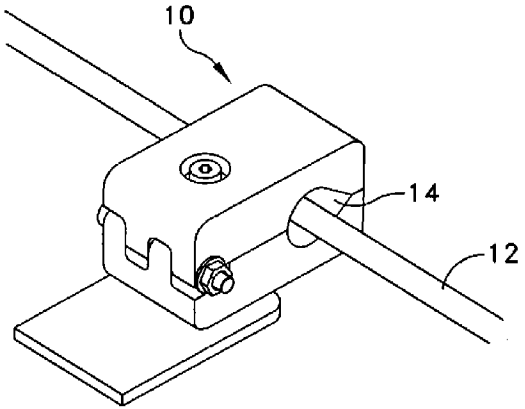
FIG. 1 is an illustration of the towline guide clip containing a towline.
Figure 3:
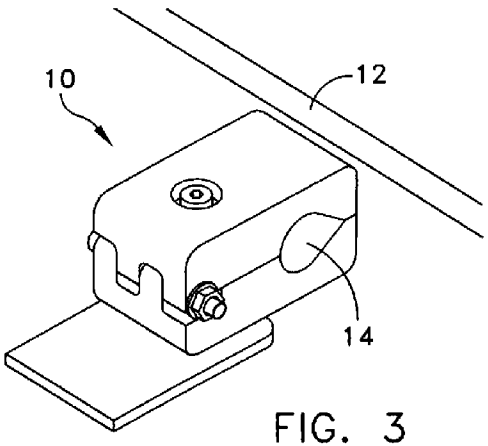
FIG. 3 is an illustration of the towline guide clip and the released towline.

Referring to FIGS. 1, 2 and 3 there is illustrated the towline guide clip 10 in use, and the progression of the towline 12 being released from the towline guide clip 10. In FIG. 1, the towline 12 in only under tension from being dragged behind a host ship. The drag forces are not sufficient to pull the towline 12 out of the towline guide clip 10. In FIG. 2, the towline 12 in under greater tension from the additional force of a small vessel that has just hooked the towline 12. The additional force applied to the towline 12 by the small vessel pulls the towline 12 into the end of the teardrop shaped hole 14 in the towline guide clip 10 causing the towline 12 to begin to wedge itself free of the towline guide clip 10. In FIG. 3 the towline 12 is under maximum tension because of the drag from the small vessel, and completely free of the clip.

Figure 4:
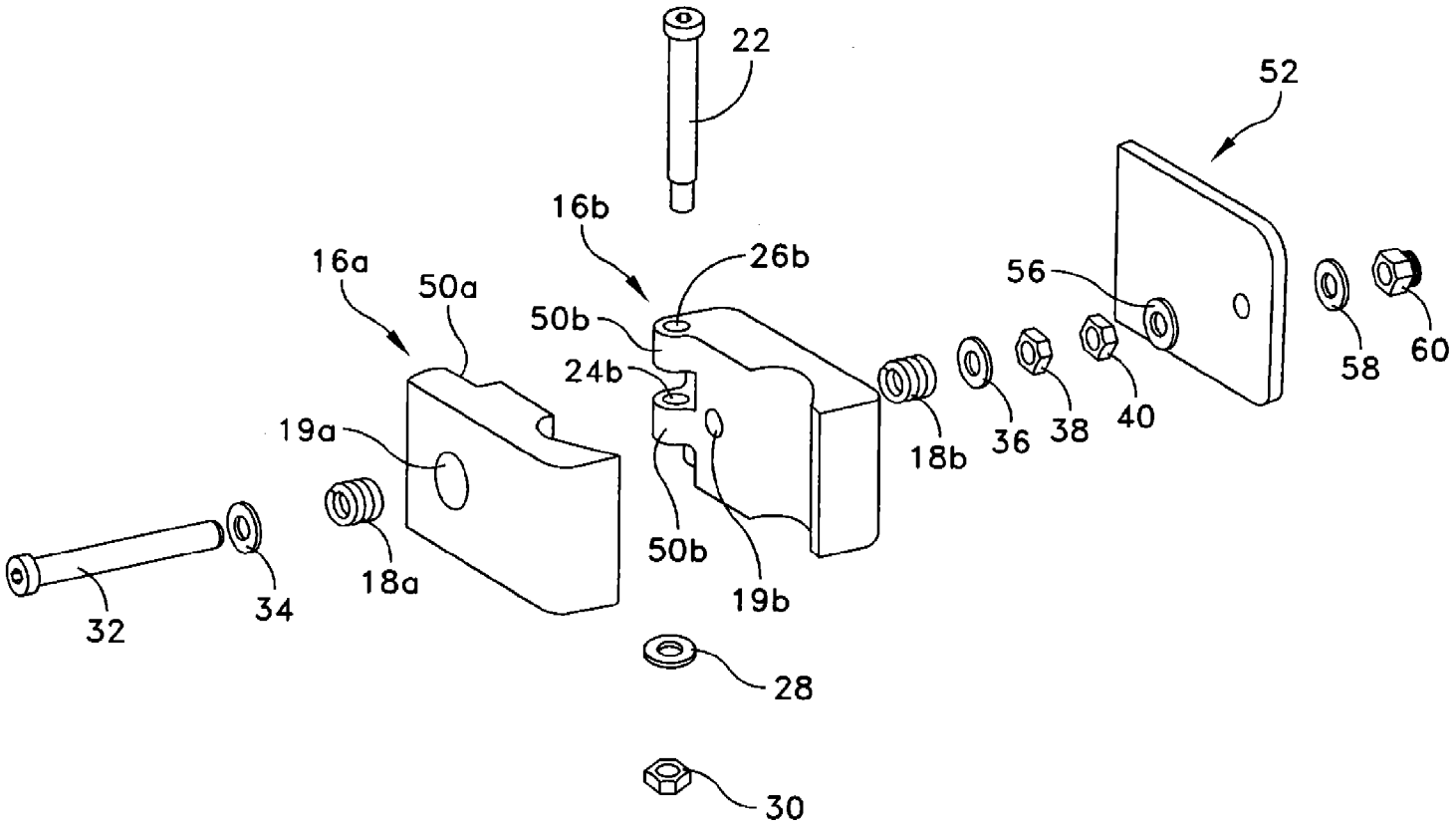
FIG. 4 is an exploded view of the towline guide clip of the present invention.
Figure 6:
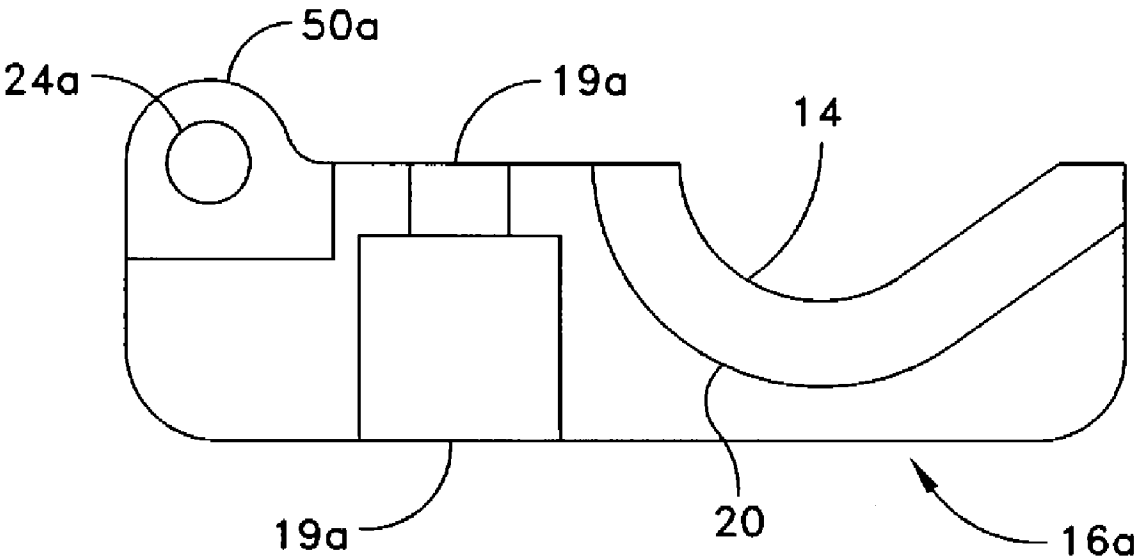
FIG. 6 is an illustration of a fastening appendage.

Referring to FIG. 4 there is illustrated an exploded view of the present invention. The towline guide clip 10 is similar to a clothespin in that the body of the apparatus comprises two fastening appendages 16*a* and 16*b*. They are identical in size, shape and material. When the two fastening appendages 16*a* and 16*b* are joined together they form the tear drop shaped hole 14. This is the portion of the apparatus that holds the towline 12, and allows it to be properly retained while still capable of being reeled in and out. A unique feature of the teardrop shaped hole 14 is the fairlead rounded edge 20 that has a radius as illustrated in FIG. 6. The rounded edge 20 allows for minimal wear on the towline 12, which becomes increasingly important due to the fact that the towline 12 will have to be a plastic product capable of floating in water. The teardrop shape is used so that when the towline 12 is put under increased tension and forced to release from the towline guide clip 10, the towline 12 will put equal force on both the top and bottom fastening appendage 16*a* and 16*b*. The equal force placed on both the top and bottom fastening appendage 16*a* and 16*b* will allow for a consistent release of the towline 12 from the towline guide clip 10.

The two fastening appendages 16*a* and 16*b* are hinged at one end and are held in a clamped position by way of a spring force. The spring force is provided by two compression springs 18*a* and 18*b* that are fitted into cylindrical apertures 19*a* and 19*b* within each of the respective fastening appendages 16*a* and 16*b*. Unlike a clothespin, however, the towline guide clip 10 allows the towline 12 to move inside of the teardrop shaped hole 14 with a fairlead edge 20, allowing for reel out of the towline 12. The two fastening appendages 16*a* and 16*b* hinge about a shoulder bolt 22 that also serves to connect the two fastening appendages 16*a* and 16*b* together. The shoulder bolt 22 is inserted through the four bolt holes 24*a*, 24*b*, 26*a* and 26*b* located in the two fastening appendages 16*a* and 16*b*. The bolt holes are located in the two protruding sections 50*a* and 50*b* of the two fastening appendages 16*a* and 16*b*. When the two protruding sections 50*a* and 50*b* are joined, they form the knuckles of the hinge part of the towline guide clip 10. The four bolt holes 24*a*, 24*b*, 26*a* and 26*b* are placed concentrically within the rounded protruding sections 50*a* and 50*b*, therefore making easy alignment with the two fastening appendages 16*a* and 16*b*. The shoulder bolt 22 is fastened to the two fastening appendages 16*a* and 16*b* body by a washer 28 and nut 30. The shoulder bolt 22 will essentially act as pin in a hinge assembly. The shoulder of the bolt 22 will be just slightly longer than width of the fastening appendages 16*a* and 16*b* so that when the nut 30 is secured it tightens up against the face of the shoulder and not the towline guide clip 10 so as not to prevent or hinder opening and closing movements of the two fastening appendages 16*a* and 16*b*.

The two compression springs 18*a* and 18*b* are secured to the fastening appendages 16*a* and 16*b* with a shoulder bolt 32 that passes through the counter bored cylindrical apertures 19*a* and 19*b*. Washers 34 and 36 and nuts 38 and 40 hold the springs 18*a* and 18*b* onto the two fastening appendages 16*a* and 16*b*. The counter bored cylindrical apertures 19*a* and 19*b* are large enough to allow complete containment of the compression springs 18*a* and 18*b* within the exterior of the fastening appendages 16*a* and 16*b*.

The shoulder bolt 32 that penetrates the middle of the towline guide clip 10 is a fully threaded bolt. This is the portion of the mechanism that provides the clamping force of the towline guide clip 10. The shoulder bolt 32 that penetrates the middle of the towline guide clip 10 body performs two main tasks; providing the means for compression force and providing the means for fastening the towline guide clip 10 to a support structure 52.

Figure 5:
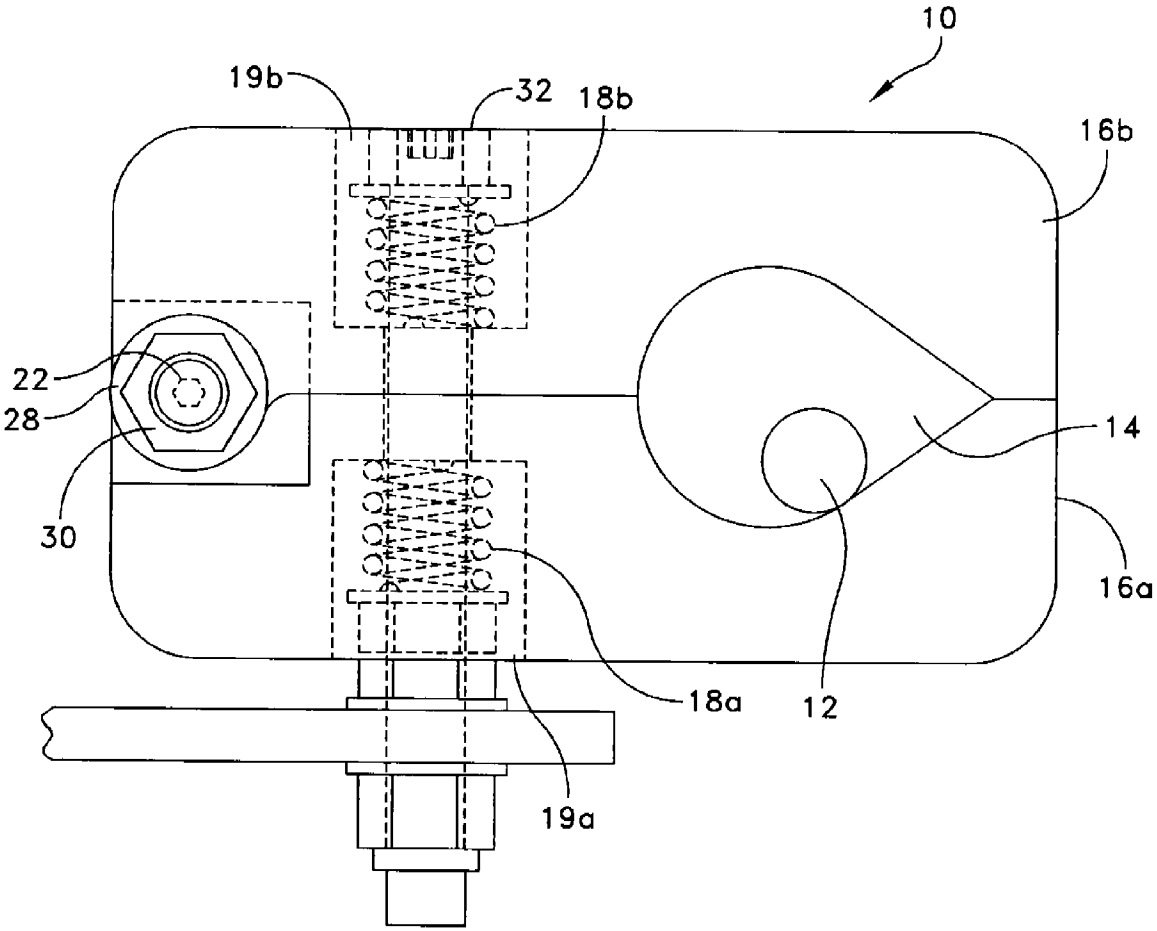
FIG. 5 is an illustration of a profile view of the towline guide clip threaded bolt assembly.
Figure 8:
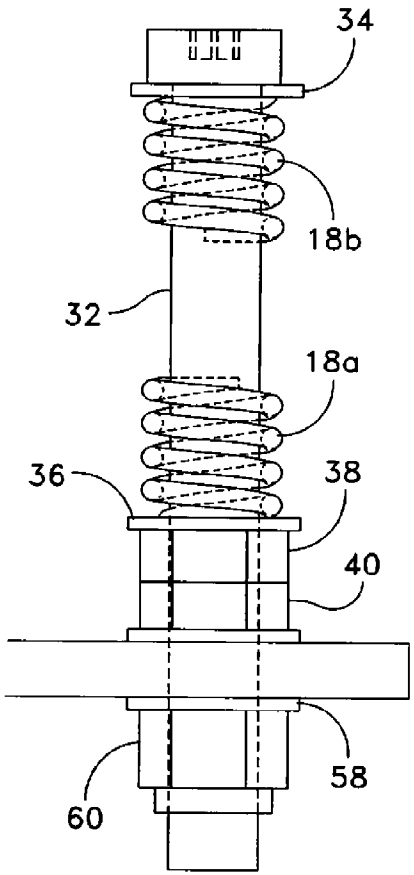
FIG. 8 is an illustration of the threaded shoulder bolt assembly with the compression springs.

Referring to FIGS. 5, 6 and 8, there is illustrated a specific process to follow when assembling the towline guide clip 10. The shoulder bolt 32 will penetrate a washer 34, compression spring 18*a* and fastening appendage 16*a* in order, and then fastening appendage 16*b*, compression spring 18*b* and then a washer 36. A nut 38 will be placed on the shoulder bolt 32 and screwed on to start compressing the compression springs 18*a* and 18*b* to create a clamping force. When the desired clamping force is accomplished, a second nut 40 that serves as a jam nut will be placed adjacently to the first nut 38. Both nuts 38 and 40 will be tightened together so that there will be no movement of the first nut 38 while the jam nut 40 sets the clamping force of the towline guide clip 10. The second task of the threaded shoulder bolt 32 is fastening to the towline guide clip 10 to support structure 52. The support structure 52 lies at the end of the stern ramp 54, on both the port and starboard side, giving the towline 12 the necessary separation distance to get the ideal towline geometry. The threaded shoulder bolt 32 penetrates the support structure 52. A pair of washers 56 and 58 straddle the plate. The support structure 52 with washers 56 and 58 will butt up against the jam nut 40. A lock nut 60 will fasten the towline guide clip 10 to the support structure 52. The locknut 60 will be secured to the bolt 32, but not so tight as to render the towline guide clip 10 fixed immovably to the support structure 52. It is necessary to allow the towline guide clip 10 to swivel under direction from tension of the towline 12 and locate itself to best release the towline 12.

The towline guide clip 10 is designed to allow for adjustment to the compression force preset on the compression springs 18*a* and 18*b*. This is especially useful when the diameter of the towline 12 changes or the drag force is increased to due to higher traveling rates of the larger host ship.

Figure 7A:
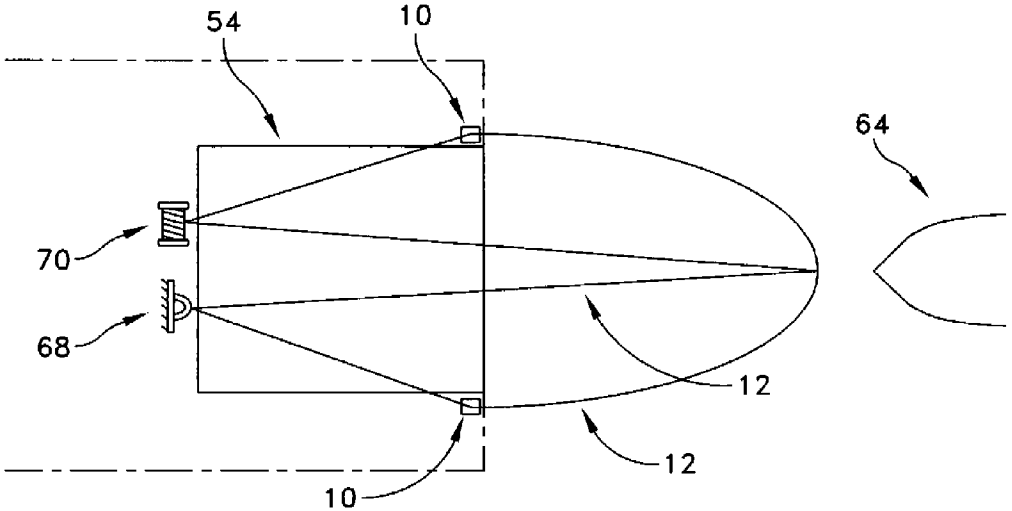
FIG. 7*a* is an illustration of an overhead view of small vessel approaching the towline.
Figure 7B:
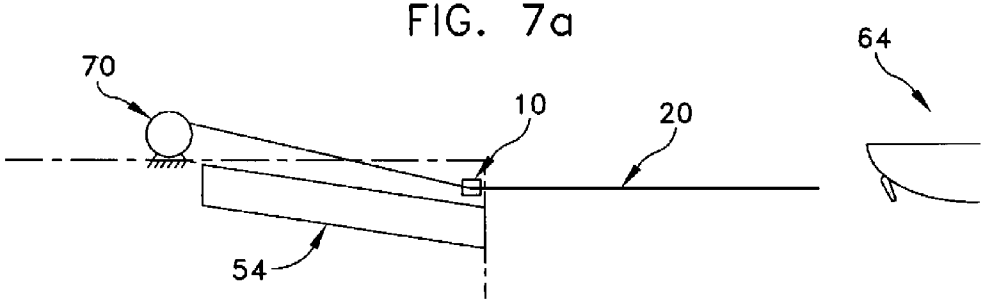
FIG. 7*b* is an illustration of a side view of a small vessel approaching the towline.

FIGS. 7*a* and 7*b* show the environment that the towline guide clip 10 will be used in. The major components of the environment are the stern ramp 54 that is part of the large host ship, the towline 12, two towline guide clips 10 and also the small vessel with latch hook. FIG. 7*a* illustrates the towline 12 in the optimum shape as it extends outboard of the stern ramp. The optimum shape is created by the towline 12 being inside the two towline guide clips 10. This is the ideal shape for recovery because of the ability of the hook to latch onto the towline 12. Once the hook of the small vessel has latched onto the towline 12 and towline 12 is free of the towline guide clips 10, the towline 12 takes the very acute "v" shape that correlates to a direct line of tension between winch, latch hook and mount plate for the towline anchor.

During normal operation a pair of towline guide clips 10 will be mounted on each side of a stern ramp that is on a larger host ship. During recovery of the small vessel, the towline 12 will be reeled out to a point where the towline could be secured within both towline guide clips 10, and also in the water to be dragged. The towline 12 will be dragged behind the large host ship in the desired geometry shape due to the towline guide clips 10. When the smaller vessel approaches the larger vessel it will grab the towline 12 with the hook and then start to decelerate. When the small vessel decelerates the large host ship will be traveling faster. At that point a direct line of tension will start to be created from winch to small vessel back to the mounting plate of the towline anchor 68, which will put additional tension on the towline 12. At that point, a time when tension is greater than drag forces but less than towing force, the towline guide clips 10 will release the towline 12. The winch 70 will begin to reel in, aiding the small vessel in boarding the stern ramp The towline guide clip 10 can be constructed out of a variety of materials. The preferred material is a hard plastic. Other options include aluminum, steel, stainless steel and other hard materials to hold up to the forces generated by the compression springs. However, when dissimilar metals are present in an electrolytic environment, galvanic corrosion could occur. Considering the fastening devices, including nuts, bolts and washer will most likely be stainless steel, the plastic would be the preferred material for the towline guide clip 10.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

What is claimed is:

1. A towline guide clip comprising:

a first fastening appendage having a protruding section with a plurality of bolt holes and a cylindrical aperture;

a second fastening appendage identical to said first fasting appendage joined to said first fastening appendage by a first shoulder bolt that fits through said plurality of bolt holes and acts as a pin to hinge both fastening appendages, wherein said first fastening appendage and said second fastening appendage form a tear drop shaped aperture when joined in a closed position;

a first compression spring located in the cylindrical aperture of the first fastening appendage;

a second compression spring located in the cylindrical aperture of the second fastening appendage; and a second shoulder bolt that passes through each cylindrical aperture of said first and second fastening appendage, wherein said bolt secures said first and second compressions springs to said first and second fastening appendages through the use of a plurality of washers and nuts, thereby creating a compression force that keeps the first and second fastening appendages in a closed position.

2. The towline guide clip of claim 1 wherein said tear drop shaped aperture has rounded fairlead edges.

3. The towline guide clip of claim 1 wherein said second shoulder bolt attaches the towline guide clip to the a support structure on a large marine host vessel through the use of a plurality of washers and nuts.

4. The towline guide clip of claim 1 wherein the one of the plurality of nuts joined to said second shoulder bolt can be loosened or tightened to adjust the compression force that keeps the first and second fastening appendages in a closed position.

* * * * *